United States Patent [19]

Jung et al.

[11] 4,455,965

[45] Jun. 26, 1984

[54] AUTOMATIC PROCESS AND SYSTEM FOR PAINTING MOTOR VEHICLE INTERIORS

[75] Inventors: Jean Jung, Montrouge; Pierre Gourdou, Paris; Yvon Jacob, Droue sur Drouette, all of France

[73] Assignee: Regie Nationale des Usines Renault, Boulogne-Billancourt, France

[21] Appl. No.: 460,948

[22] Filed: Jan. 25, 1983

[30] Foreign Application Priority Data

Feb. 26, 1982 [FR] France ..... 82 03293

[51] Int. Cl.[3] ..... B05B 3/12; B05B 5/02; B05B 13/06

[52] U.S. Cl. ..... 118/622; 118/317; 118/631; 134/167 R

[58] Field of Search ..... 427/28, 29, 230, 236, 427/239; 118/622, 630, 631, 317, 318; 134/45, 46, 123, 167 R, 168, 198, 199

[56] References Cited

U.S. PATENT DOCUMENTS

| | | | |
|---|---|---|---|
| 1,786,785 | 12/1930 | Spaulding | 118/317 |
| 1,982,763 | 12/1934 | Russell et al. | 427/135 |
| 2,048,912 | 7/1936 | Ziska et al. | 118/317 |
| 2,168,917 | 8/1939 | Perkins | 118/317 |
| 2,826,513 | 3/1958 | Blanchard | 427/28 |
| 2,893,893 | 7/1959 | Crouse | 427/28 |
| 3,351,289 | 11/1967 | DeMaison | 118/317 |
| 3,448,717 | 6/1969 | Kuhlman | 118/317 |
| 3,461,889 | 8/1969 | Saxonmeyer | 118/317 |
| 3,477,870 | 11/1969 | Boretti et al. . | |
| 3,961,983 | 6/1976 | Crandall et al. | 134/168 R |
| 4,106,516 | 8/1978 | Wiegand | 134/123 |
| 4,106,760 | 8/1978 | Kono et al. | 118/317 |
| 4,268,543 | 5/1981 | Hoffken et al. | 427/230 |
| 4,291,640 | 9/1981 | Payne et al. | 427/28 |

*Primary Examiner*—John H. Newsome

*Attorney, Agent, or Firm*—Oblon, Fisher, Spivak, McClelland & Maier

[57] ABSTRACT

An automatic system for painting the interiors of vehicle bodies having a large opening at the rear, particularly industrial vehicles, including a mechanism which supports two electrostatic paint sprayers and which is designed to move these according to three movements which respectively modify their spacing, their distance from the axis and their overall position relative to the axis. Handling equipment produces a fourth movement consisting of a controlled backward and forward movement of the vehicle body along the vehicle axis.

4 Claims, 6 Drawing Figures

AUTOMATIC PROCESS AND SYSTEM FOR PAINTING MOTOR VEHICLE INTERIORS

BACKGROUND OF THE INVENTION

1. Field of the Invention

The invention relates to the painting of interior surfaces of motor vehicle bodies, or of similar enclosures such as cabs, containers or trailers.

2. Description of the Prior Art

Painting of vehicle exteriors using electrostatic rotating spraying heads is a common practice. This method is advantageous in that it yields excellent results in paint application (quantity of paint applied relative to spray gun output). However, the interior surfaces cannot be covered by the paint expelled from an electrostatic sprayer located on the outside of the vehicle, due to the Faraday cage effect which shields the interior space from penetration by an electrical field.

For this reason, vehicle interiors are normally painted by using non-electrostatic sprayers which are moved using a relatively complex movement. This movement is performed manually, under difficult and unhealthful conditions. In addition, a significant amount of paint is wasted and deposited in the surrounding area.

SUMMARY OF THE INVENTION

The object of this invention is to obviate the above disadvantages by providing a system for painting interiors in a simple, efficient and economical manner. The invention consists of using at least one electrostatic rotating spraying head which is moved inside the grounded body or enclosure by a simple movement. The effect is a reverse Faraday cage effect, wherein the electrical field is confined inside the vehicle body, preventing nearly all the paint particles from escaping from the body. In the event that a very small proportion of paint particles might escape through the larger openings, these would not be wasted but would be electrostatically attracted to the contours of those openings, which are normally difficult to paint.

The paint yield is therefore even higher than for conventional exterior painting methods, and the movements required to position the electrostatic spraying heads which rotate at high speed are substantially simplified.

According to one embodiment of the invention, which is particularly designed for large size industrial vehicles, the system comprises a three-directional mechanism which supports the electrostatic sprayers and provides, respectively, for the modification of their spacing, of their distance from the axis of the vehicle and of their overall position around said axis. The system also includes a handling mechanism which moves the vehicle in a back-and-forth movement along its axis.

In another embodiment of the invention, which is more particularly designed for passenger automobiles, the bodies move uniformly on an assembly line, and a single electrostatic rotating head is moved inside and towards the front of the vehicle, assuming a fixed position. A bi-directional device provides lateral retraction of the sprayer and its surrounding arm, and allows it to move backward through the rear opening in the vehicle, and forward to the front position in the vehicle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The process according to the invention consists of moving at least one high-speed, rotating electrostatic head relative to the body to be painted, using simple movements. There are several methods of providing this relative movement.

Figure 1:
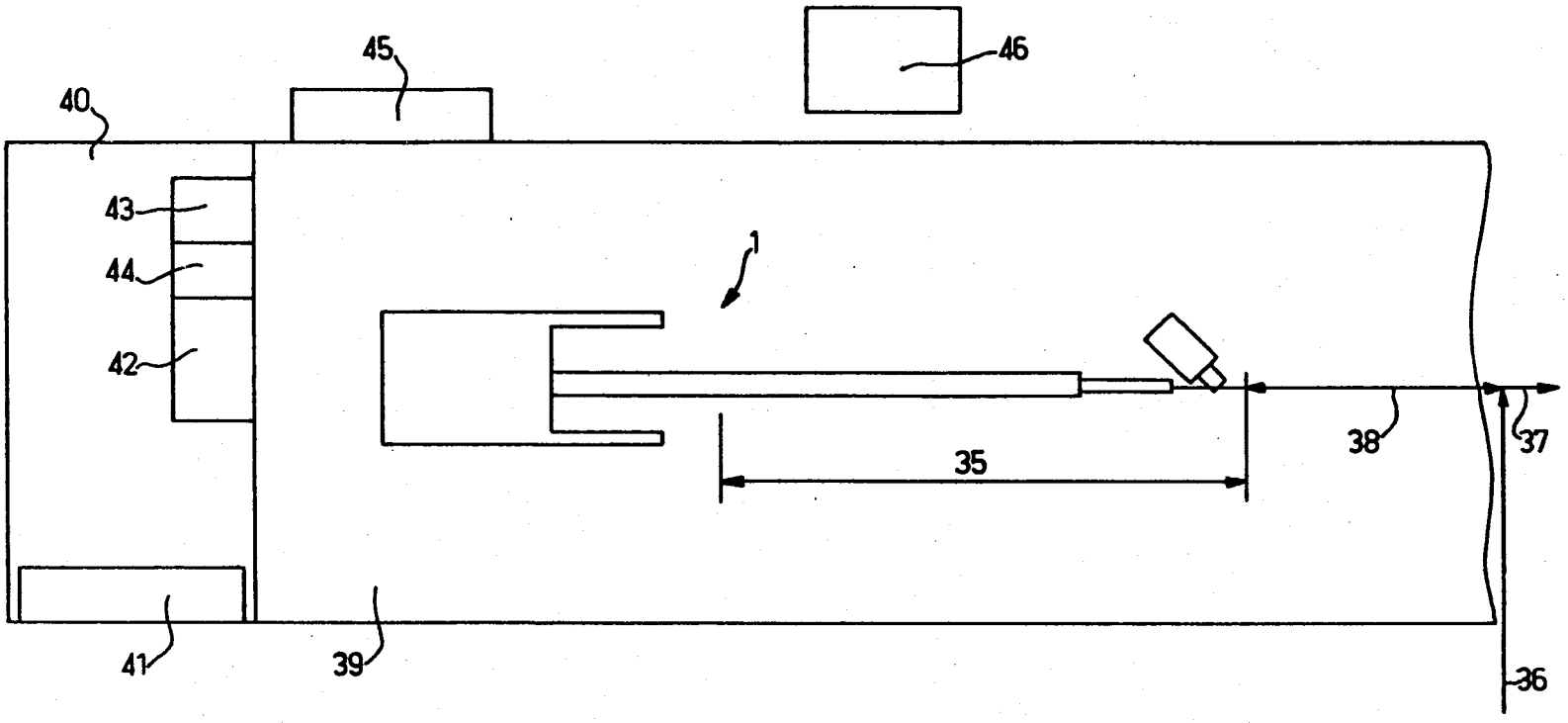
FIG. 1 is a schematic view of the top of the system according to the first embodiment.
Figure 2:
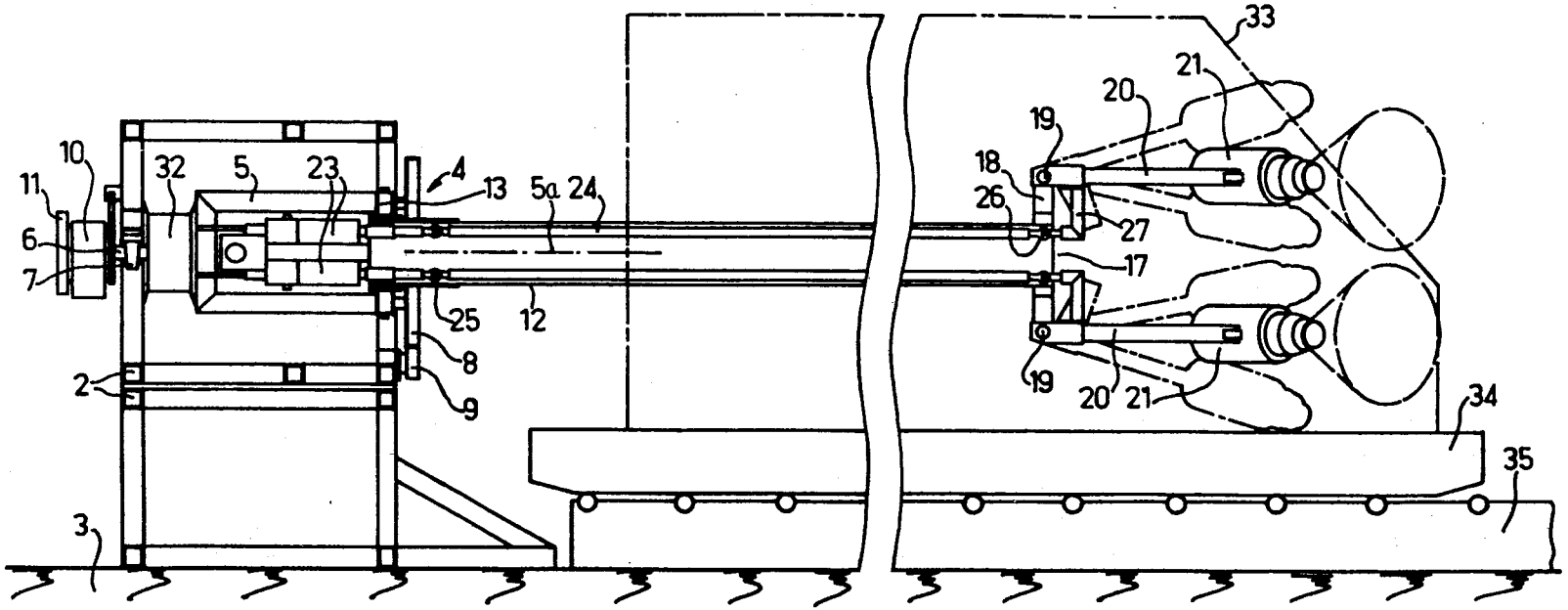
FIG. 2 is a partial vertical section of the main component of the system.
Figure 3:
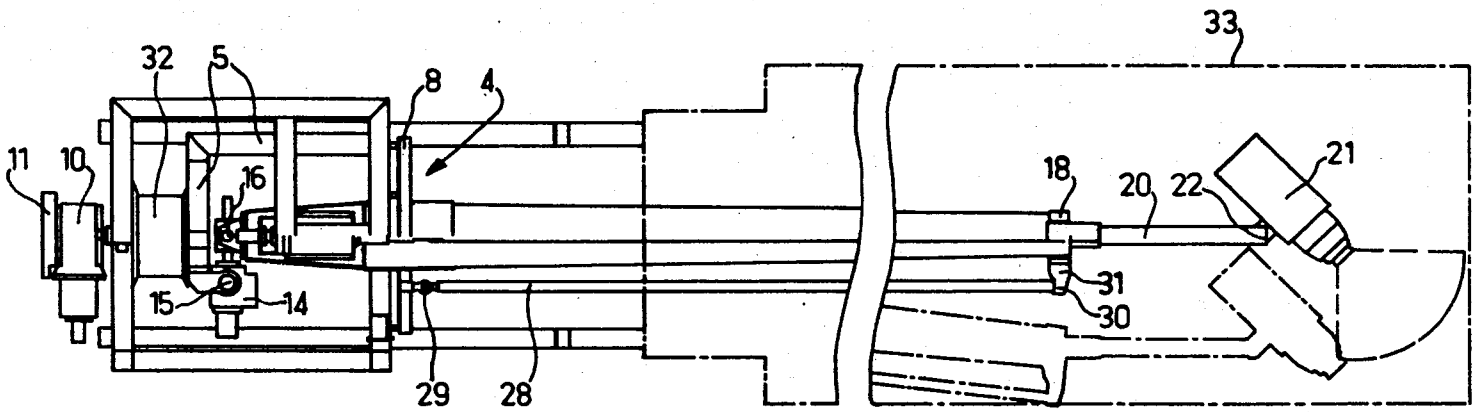
FIG. 3 is a view of the top of the main component.

In the first embodiment, which is shown in FIGS. 1 to 3, the essential mechanism of the invention is shown in detail in FIGS. 2 and 3. This mechanism comprises a fixed support 2 which is solidly anchored to the floor 3 and which rotatably supports a cradle 4 which rotates about a horizontal axis 5*a* which is the main axis of the system.

This cradle 4 includes a cage 5 having, at its back end, a spindle 6 which rotates in a support 7 which is an integral part of the support 2. At its front end, the cage includes a ring 8 which rests on rollers 9 which rotate around spindles fixed on the support 2. The cradle 4 can be slowly rotated about at least ¾ of a turn by a servo-motor 10, which is preferably hydraulic. The rotation of the cradle 4 is controlled using an angular position guide device 11 formed of a platter or drum which is an integral part of the end of spindle 6 and which moves in front of one or more fixed sensors so that the position of the angle of cradle 4 can be determined at all times.

A cantilever beam 12, preferably a box beam with an evolving shape along its length, is mounted on the cradle. The beam's attached end is articulated around a spindle 13, which is mounted on cage 5 perpendicular to axis 5*a* so that it rotates in cradle 4 in direct proximity to ring 8. The beam 12 can therefore pivot about spindle 13 to assume a position where its own axis is coincident with horizontal axis 5*a*, or to move away from this axis at an angle. The movement of beam 12 away from axis 5*a* is triggered by another servo-motor 14, which is also preferably hydraulic. The motor 14 is fixed at point 15 to the cage 5 and acts on a joint 16, supported on the end of beam 12 and positioned inside the cage 4, in order to move the beam. This servo-motor 14 is capable of moving beam 12 at an angle away from axis 5*a* or returning it to this axis, for all angular positions of cradle 4. Beam 12 may thus move to the right or left or above or below axis 5*a*, for four preferential positions of cradle 4.

At the free end 17 of beam 12 is attached a perpendicular cross-piece 18, which is generally parallel to spindle 13. Each end of this cross-piece 18 includes a hinge pin 19 to which an arm 20 is attached. The two hinge pins 19 supported by the cross-piece 18 are also parallel, so that the two arms 20 always lie in the same plane.

Each arm 20 supports, at its free end, a high-speed rotating electrostatic sprayer 21 of a conventional type, which is mounted at 22 on arm 20 in such a way that the angular position of the sprayer can be adjusted about two axes perpendicular to the length of arm 20. In addition, each sprayer 21 includes the normal mechanisms for adjusting the nozzle and, of course, for the supply of paint, energy and electrostatic potential.

The angular movement of each arm 20 on the cross-piece 18 is obtained separately by a jack or special servo-motor 23 located in the cage 5 and which acts from a distance through a linkage or connecting rod 24 which preferably passes through the beam 12 and is articulated at 25 on one end of beam 12, and at 26 on the other end of the beam 12. Lever arm 27 is positioned essentially perpendicular to the corresponding arm 20 and connects rod 24 with arm 20. This remote action provides for reducing the weight on the free end of the beam to reduce the rocking torque needed for the support 2, and to avoid the use of hydraulic actuators (which are likely to leak oil) in the enclosure to be painted.

In addition, there is preferably provided another connecting rod 28 which is articulated at 29 on the ring 8 and at 30 on an extension 31 on the bottom of cross-piece 18. The cross-piece is mounted so that it can rotate around an axis parallel to its length. In this way, the assembly formed of beam 12 and connecting rod 28 forms an articulated parallelogram which maintains the plane defined by the two arms 20 constantly parallel to axis 5*a*. This avoids variations of the angle of incidence of the spray relative to the various walls of the enclosure. The dotted lines in FIG. 3 show the extreme position that can be assumed by the beam, the arms and the sprayers when the cradle assembly is positioned toward the interior right wall of the vehicle.

Behind cradle 4, between cage 5 and support 7, is positioned a drum 32. All of the wires and flexible supply conduits of the various active elements of cradle 4 are wrapped around this drum during cradle rotation.

It is apparent from the preceding description that the two sprayers 21 may be moved in such a way as to vary their spacing symmetrically or asymmetrically relative to beam 12 by individual action on the jacks 23, and to vary their distance from axis 5*a* by varying the angle of beam 12 relative to said axis 5*a* through servo-motor 14. Finally, it is possible to vary the position of the entire cradle assembly by rotation around axis 5*a* to successively position the nozzles toward the four main walls of the vehicle.

In addition to these three main movements, the invention provides for a fourth movement which consists of moving the vehicle along its longitudinal axis. For this purpose, each vehicle body 33 is placed on a supporting frame 34 which follows it during a large part of the manufacturing process. This frame 34 may be moved onto a handling platform 35 including a slow conveyor, the speed of which is adjustable using a device which provides incremental data on the position of the frame to allow for determination of the vehicle's position at all times and to reposition the sprayers or change the parameters of paint being applied based on this data. As will be shown below, it is necessary for this frame to perform two successive forward movements and two successive backward movements in order to paint the four interior walls of the body.

Of course, in addition to the handling conveyor 35 which is an integral part of the painting system, the system also comprises the usual conveyor beds designed to move the bodies to be painted in place and to withdraw the painted bodies. However, these conveyors must conform to the fact that the bodies must be moved in and out from the same side, since the body cannot pass over the obstacle formed by the support 2. More specifically, a transverse conveyor, schematically represented by arrow 36 on FIG. 1, may be provided for bringing the bodies in place, and an in-line conveyor 37 for removing them, with a shared back-and-forth section 38. It is also of course possible to provide an in-line introduction, and transverse removal, conveyor.

In addition to handling devices 35, 36, 37 and 38, and the essential mechanism 1 which has been described above, the overall system shown in FIG. 1 includes a painting enclosure 39 having only one opening on the side of the conveyor 38. The enclosure 39 is contiguous to a control station 40. The control station 40 includes a programmable unit 41, a computer console for programming the various paint and positioning parameters for introducing the different types of bodies to be processed on the equipment, and, for each different type of body, the various parameters governing the position of the sprayers and the painting parameters such as nozzle flow and diameter. A display screen 43 is provided for reading the operating status of the machine in the automatic mode and, in the read or write mode, to display the tables, that is, the sequence of orders in plain language in the time frame, or as a function of the position of the vehicles on handling platform 35 for each of the pre-programmed types of vehicles. Finally, a console 44 allows for selection in plain language, in the form of a decision chart—given the very large number of possible variations—the type of body and the desired color, in order to automatically trigger all movements and parameter adjustments needed for the paint job, including emptying and cleaning the sprayers if a different color is selected. Reference numbers 45 and 46 designate, respectively, the air compressor and hydraulic system used to supply the system.

This automatic assembly causes movement of the frame 34 and the vehicle 33 which it carries, with the vehicle's rear opening in front to enable passage of the beam 12. The right inside wall is painted during the first backward movement (to the left in FIG. 2), while, if necessary, the spacing between the sprayers and their distance from axis 5 is constantly modified, if necessary, by changing the angle of the beam, for example, to work around the wheel wells. When the front interior panel arrives near the sprayers 21, the device automatically reverses the direction of movement to move the vehicle towards the front (to the right in FIG. 2) while, simultaneously, the cradle 4 rotates one-quarter turn to position the sprayers toward the roof, causing revision and permanent modification of all other adjustments, if necessary, during the second forward cycle of the vehicle. The left side wall is then painted in the same manner, after a second quarter turn of cradle 4 and a new backward movement. The floor is painted during the final forward movement, after which the frame 34 is removed.

For smaller vehicle bodies, more particularly for normal passenger automobiles, a single rotating head positioned along the axis of the vehicle and having a relative movement along this axis may be employed to paint all interior surfaces. In this instance, both the spreading movements, the beam rotation and angular movements may be eliminated; that is, a fixed beam may be employed and the body can be moved in a back-and-forth movement as described above.

Figure 4:
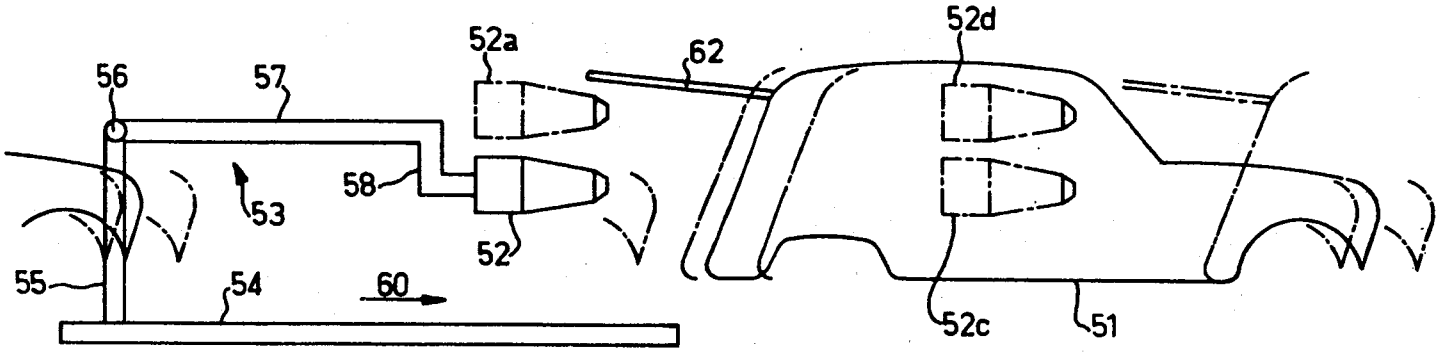
FIG. 4 is a side view of the system according to the second embodiment.
Figure 5:
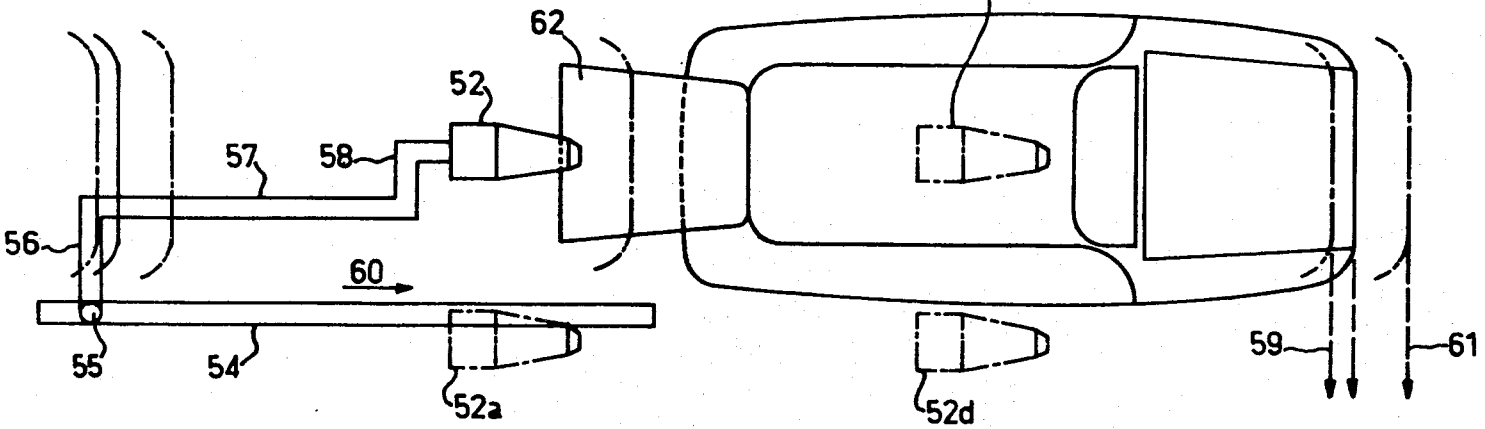
FIG. 5 is a view of the top of the second embodiment.
Figure 6:
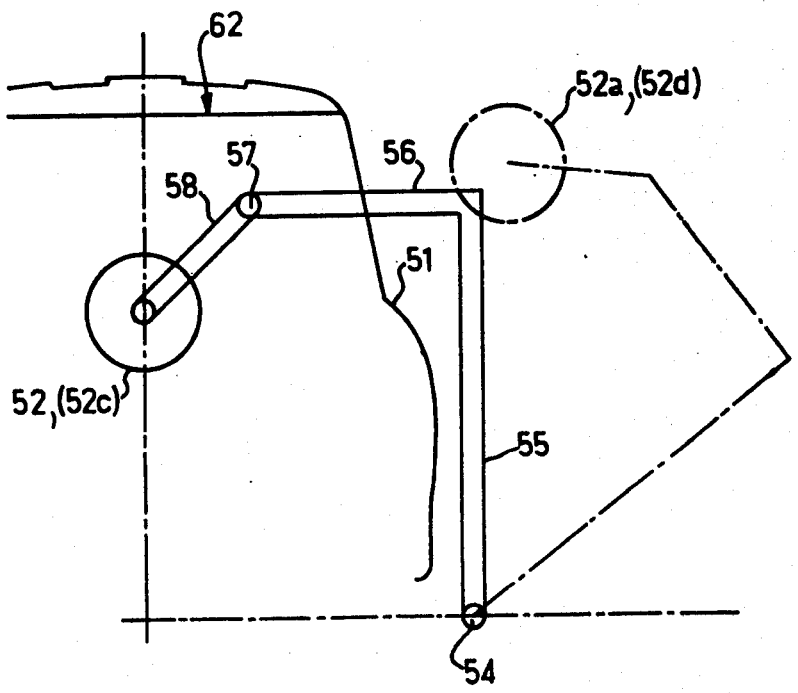
FIG. 6 is a view from the end of the conveyor line showing the rocking motion of the system of the second embodiment.

However, in order to better comply with the higher standards of productivity normally required for these lighter vehicles, it is preferable to use the system according to the second embodiment shown in FIGS. 4 to 6.

In this example, the bodies 51 are painted on the conveyor line and are handled by a platform or a hoist conveyor (not shown) operating at constant speed. However, it is necessary to leave a space for the painting mechanism between two successive vehicles, a distance on the order of 1.5 m on average, but which can vary depending on the size of the body.

The paint sprayer 52 is of the same type as sprayers 21 described in the preceding example, but only one is provided. It sprays the paint toward the front at a wide angle of dispersion and is positioned horizontally along the vehicle axis. The sprayer 52 is supported by an angled beam 53 which successively includes a lower portion 54, which is parallel to the axis of the assembly line and positioned at the side of the line, as shown in FIG. 6. Near the back end of part 54 there extends a part 55 which is substantially perpendicular to it and which is nearly vertical in its operating position. A part 56 extends from part 55; the part 56 is substantially horizontal and transverse to the conveyor line in the operating position in order to pass over the hood of the next vehicle in line. A rectilinear longitudinal part 57 extends from part 56, forming the main body of the beam, at the front end of which a part 58 with two hinge points supports sprayer 52.

It is understood that all of the parts 54 through 58, which form a rigid integral whole, contain power and paint supplies.

In addition, the part 54 can move in two directions, that is, it can slide in the direction of its longitudinal axis over a distance which substantially equals the distance between two vehicles, and it can rotate around this axis to move the assembly from the solid line position, where sprayer 52 is along the axis of the vehicle, to a lateral position **52*a* or 52*d* shown in dotted lines on the right of FIG. 6 and where no part of beam 53 or of sprayer 52 forms an obstacle to the passage of the bodies 51**.

As a variation, the rocking movement around 54 could be substituted by a horizontal movement of translation perpendicular to the conveyor line.

Beginning, for instance, from the vehicle position 59 where the sprayer is located at **52*a*, in the out of the way position, when a sensor senses the arrival of the continuously moving vehicle at this position it triggers the rocking motion which causes the sprayer to become positioned between the two successive vehicles, wherein this sprayer consequently moves from position 52*a* to position 52, transverse to the vehicle axis. Completion of this movement sets off a longitudinal translational movement, along the direction shown by arrow 60, of part 54 which causes the sprayer to move from position 52 to position 52*c*—in which position the sprayer is along the axis of the vehicle, but is inside the vehicle and at a desired distance from the vehicle front wall. This trajectory 60** is limited by a translational stop (not shown) which is adjusted in such a way that, even if the line stops at the beginning of the first movement, the sprayer will not collide with the vehicle dash-board at the end of the second movement.

A sensor senses the arrival of the vehicle at a position 61 so that the relative positions of the sprayer and vehicle can be determined and the desired distance between the sprayer head **52*c*** and the front wall of the vehicle can be attained. This sensor then triggers the spraying operation, which is conducted as a function of incremental data on the line advance as the vehicle moves foreward. However, if the line stops, spraying is automatically halted, and resumes when the line starts up again.

The relative positions of the sprayer and the vehicle can be determined at any time by incremental readings of the line advance, which allows for variation of the painting parameters (flow, nozzle diameter) as a function of the relative position of the sprayer relative to the vehicle.

A sensor (not shown) triggers the lateral rocking movement which causes the sprayer head to move from position **52*c* to position 52*d* in the drawings, this position and this movement being such that it occurs when the vehicle has moved foreward to a position where the sprayer will not collide with parts of the vehicle body, or with its rear hatch 62. When this final movement reaches the end of its cycle, the longitudinal translational movement of the part 54 is triggered, in the direction opposite that shown by arrow 60, and the sprayer is returned to position 52*a* where it will remain until it receives the signal from the detector for position 59** to begin a new cycle for the following vehicle.

Of course, the various vehicle position sensors which have just been described may be substituted for by a like device, for instance an incremental counter having a single sensor.

Each repetitive movement must be completed prior to the end of a predetermined maximum time period, or additional safety devices will trigger emergency stopping to prevent collisions. In addition, a device to empty the sprayer when paint color is changed may also be provided.

Given the magnitude of the distances between the sprayer head 52 and the various longitudinal and transverse walls of the vehicle, neither the longitudinal nor transverse guiding or positioning of the body requires high precision, since high absolute value tolerances translate into small relative variations at these distances. Because of this, "all-or-none" commands may be used without the necessity of precision controls. The assembly therefore combines great simplicity with high productivity, while maintaining high quality and the high yield.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for painting the interiors of vehicle body enclosures, comprising:

first means for supporting a vehicle and moving said vehicle along a first axis;

two electrostatic paint sprayers;

second means for supporting said sprayers along a second axis transverse to said first axis;

third means for varying the relative mutual positions of said sprayers;

fourth means for varying the distance of said sprayers relative to said first axis; and fifth means for varying the angular circumferential position of said sprayers about said first axis, whereby said sprayers may be positioned so as to paint the entire interior of said vehicle, wherein said second means comprises a fixed support;

said fifth means comprises a cradle mounted on said fixed support for rotation about said first axis;

said fourth means comprise a box beam pivotally mounted on said cradle about a third axis transverse to said first and second axes, and means for controlling the angular position of said box beam about said third axis;

wherein said third means comprise a cross piece mounted parallel to said third axis on an end of said box beam opposite said cradle, two arms, one end of each said arm pivotally mounted on each end of said cross piece about parallel fourth axes, said arms extending in a common plane and said sprayers mounted on the other end of each said arm, and servomotor means for pivoting each said arm about a respective fourth axis, and wherein said cross piece is rotatable about a fifth axis parallel to the length of said cross piece, said apparatus including an articulated link pivoted between said cradle and said cross piece, wherein said common plane is always parallel to said first axis.

2. The apparatus of claim 1 including:

an enclosure housing said apparatus;

sixth means for moving said vehicle onto, and off of said first means; and control means for controlling the operation of said first through sixth means.

3. An apparatus for painting the interiors of vehicle body enclosures, comprising:

first means for supporting a vehicle and moving said vehicle along a first axis;

an electrostatic paint sprayer;

second means for supporting said sprayer;

third means operable on said second means for moving said sprayer in a direction transverse to said first axis between a first position coincident with said first axis and a second position spaced from said first axis and lateral to the sides of said vehicle; and fourth means operable on said second means for moving said sprayer in a direction parallel to said first axis.

4. The apparatus of claim 3 wherein said second means includes a first portion positioned lateral to said sides of said vehicle and having a second axis parallel to said first axis, and wherein said first portion is rotatable about said second axis to move said sprayer between said first and second positions.

* * * * *